US011697532B1

(12) United States Patent
Cheng

(10) Patent No.: US 11,697,532 B1
(45) Date of Patent: Jul. 11, 2023

(54) CONTAINER LID AND CONTAINER

(71) Applicant: ZHEJIANG HAODA SCIENCE & TECHNOLOGY CO., LTD, Jinhua (CN)

(72) Inventor: Haojun Cheng, Jinhua (CN)

(73) Assignee: ZHEJIANG HAODA SCIENCE & TECHNOLOGY CO., LTD, Jinhua (CN)

( * ) Notice: Subject to any disclaimer, the term of this patent is extended or adjusted under 35 U.S.C. 154(b) by 0 days.

(21) Appl. No.: 17/562,385

(22) Filed: Dec. 27, 2021

(30) Foreign Application Priority Data

Dec. 18, 2021 (CN) ..... 202123211305.1

(51) Int. Cl.
*B65D 47/28* (2006.01)
*A45F 3/18* (2006.01)
*B65D 51/18* (2006.01)

(52) U.S. Cl.
CPC ..... *B65D 47/286* (2013.01); *A45F 3/18* (2013.01); *B65D 51/18* (2013.01); *B65D 2251/0025* (2013.01); *B65D 2251/0081* (2013.01)

(58) Field of Classification Search
CPC ..... B65D 47/286; B65D 51/18; B65D 2251/0025; B65D 2251/0081; A45F 3/18
USPC ..... 220/254, 39, 254.9
See application file for complete search history.

(56) References Cited

U.S. PATENT DOCUMENTS

2015/0060448 A1* 3/2015 Coon ..... B65D 41/28 220/254.1
2018/0050848 A1* 2/2018 Choltco-Devlin ... B65D 43/267
2019/0152661 A1* 5/2019 Seiders ..... B65D 51/1605
2020/0391910 A1* 12/2020 Pinelli ..... A47G 19/2272

FOREIGN PATENT DOCUMENTS

CN 111977158 A * 11/2020 ..... A45F 3/18
EP 3366168 A1 * 8/2018 ..... A47G 19/2272
WO WO-2022040521 A1 * 2/2022 ..... A47G 19/2272

* cited by examiner

*Primary Examiner* — J. Gregory Pickett
*Assistant Examiner* — Niki M Eloshway

(57) ABSTRACT

A container lid is provided, which includes a lid body, a sealing member, a resetting member and a slidable member. The lid body is provided with a water outlet. The sealing member is rotatably connected to the lid body, and configured to seal the water outlet. The resetting member is disposed on at least one of the lid body and the sealing member, wherein the resetting member is capable of driving the sealing member to seal the water outlet; and. The slidable member is slidably disposed on the lid body, and is disposed at a first position and a second position relative to the lid body.

7 Claims, 5 Drawing Sheets

CONTAINER LID AND CONTAINER

CROSS-REFERENCE TO RELATED APPLICATIONS

This application claims all benefits accruing under 35 U.S.C. § 119 from China Patent Application No. 202123211305.1, filed on Dec. 18, 2021, in the China National Intellectual Property Administration, the content of which is hereby incorporated by reference.

TECHNICAL FIELD

The present disclosure relates to a liquid container, in particular to, a container lid and a container.

BACKGROUND

As people's quality of life improves, so has the convenience of daily necessities. Water containers that can be opened and closed with one hand are gaining popularity. Many containers control the flow of liquid from the container lid by an opening and closing mechanism in the container lid. However, in order to open and close the container lid with one hand, water outlets of those containers are sealed by the opening and closing mechanism from an inner side of the water outlet. However, dust is easy to accumulate on an outside of the water outlet of this type of container lid, and the sanitation is poor.

SUMMARY

In view of the problems above, it is necessary to provide a container lid, which can shield a water outlet to prevent dust from falling into the water outlet, and seal the water outlet while ensuring drinking water hygiene. At the same time, it is necessary to provide a container with the container lid.

The present disclosure provides a container lid, including a lid body, a sealing member, a resetting member and a slidable member. The lid body is provided with a water outlet. The sealing member is rotatably connected to the lid body, and configured to seal the water outlet. The resetting member is disposed on at least one of the lid body and the sealing member, wherein the resetting member is capable of driving the sealing member to seal the water outlet. The slidable member is slidably disposed at a first position and a second position on the lid body. When the slidable member is disposed at the first position, the water outlet is sealed by the sealing member from an inner side of the lid body, and the water outlet is shielded by the slidable member from an outer side of the lid body. When the slidable member slides from the first position to the second position, the slidable member drives the sealing member to rotate, the water outlet is in an opened state and the water outlet is not shielded by the slidable member.

Therefore, by shielding and sealing the water outlet with the slidable member and the sealing member, drinking water hygiene of using a container with the container lid can be ensured. Furthermore, it is convenient for the user to open or close the container lid with one hand, providing more facility.

In some embodiments, the resetting member includes a first magnetic portion and a second magnetic portion. The first magnetic portion is disposed in the lid body, and the second magnetic portion is disposed in the sealing member.

The sealing member is capable of sealing the water outlet by a magnetic force between the first magnetic portion and the second magnetic portion.

Therefore, by designing the first magnetic portion and the second magnetic portion, and driving the sealing member to seal the water outlet at the inner side of the lid body by an magnetic attraction force between the first magnetic portion and the second magnetic portion, water leaking of the container lid caused by sealing failure of the resetting member after long time use can be avoided.

In some embodiments, the first magnetic portion is disposed at a side of the lid body close to the sealing member, and the second magnetic portion is disposed at a first side of the sealing member close to the lid body. The first magnetic portion is disposed corresponding to the second magnetic portion, and the second magnetic portion is disposed close to a rotation axis of the sealing member and along a longitudinal direction of the sealing member.

Therefore, by disposing the first magnetic portion adjacent to the second magnetic portion and correspondingly disposing the first magnetic portion and the second magnetic portion near the rotation axis of the sealing member, a distance between them can be effectively reduced. By reducing the distance between the first magnetic portion and the second magnetic portion, it can be ensured that the magnetic attraction force between the first magnetic portion and the second magnetic portion is relatively large, so that the sealing member has a relatively good sealing effect.

In some embodiments, the slidable member includes a driving portion. The sealing member is provided with a guiding portion at the first side of the sealing member close to the lid body, when the slidable member slides from the first position to the second position, the driving portion abuts against the guiding portion to drive the sealing member to rotate around the rotation axis of the sealing member.

Therefore, by designing the guiding portion, when the slidable member slides from the first position to the second position, the slidable member can stably drive the drive the sealing member to rotate around the rotation axis of the sealing member, thereby improving the user's experience of using the container lid.

In some embodiments, the driving portion is a protrusion disposed on the slidable member and protruding towards the sealing member. The guiding portion is provided with a guiding surface at a side of the guiding portion close to the slidable member, the guiding surface is formed by a part of the sealing member inclinedly extending along a sliding direction of the slidable member. The driving portion abuts against the guiding surface.

Therefore, by designing the guiding surface, stability of rotation of the sealing member around the pivot driven by the slidable member can be further improved.

In some embodiments, the sealing member is further provided with a matching surface, the matching surface is extended from the guiding surface. When the slidable member is disposed at the second position, a first end surface of the driving portion abuts against the matching surface to ensure the sealing member to rotate and the water outlet being in an opened state.

Therefore, by designing the matching surface, when the slidable member is disposed at the second position, the first end surface of the driving portion can abut against the matching surface, keeping the sealing member in the unsealing state. That is, abutting against between the matching surface and the first end of the driving portion can keep them in a locked state. Therefore, the user can drink water without pushing the slidable member throughout the drinking process, thereby improving the user's convenience.

In some embodiments of the present disclosure, the driving portion is provided with an abutting surface matching with the guiding surface, and a stopping surface. When the slidable member slides from the first position to the second position, the abutting surface abuts against the guiding surface. The stopping surface is disposed on the first end surface of the driving portion close to the sealing member. When the slidable member is disposed at the second position, the stopping surface abuts against the matching surface.

Therefore, by designing the abutting surface matching with the guiding surface, guiding effect of the guiding surface can be further improved. By designing the stopping surface matching with the matching surface, locking effect between the stopping surface and the matching surface can be further improved.

In some embodiments, the sealing member further includes an abutting portion, wherein the abutting portion is disposed on an end of the sealing member away from the rotation axis of the sealing member, and the guiding portion is disposed on the abutting portion.

Thus, designing the abutting portion can facilitate the sealing member to seal the water outlet at the inner side of the lid body, and facilitate matching between the guiding portion and driving portion.

In some embodiments, the container lid further includes a first gastight member disposed around the abutting portion.

Thus, by designing the first gastight member and disposing the gastight member around the abutting portion, the sealing effect of the sealing member can be better, and water will be harder to leak from the container, The present disclosure further provides a container, which includes a container body and the container lid described above. The container lid can be detachably disposed on the container body.

Therefore, that designing the container with the container lid not only can prevent dust from accumulating around the water outlet or falling into the water outlet, but also can facilitate opening and closing the container with one hand.

BRIEF DESCRIPTION OF THE DRAWINGS

FIG. 3 is a top view structural schematic diagram of the container lid in an embodiment of the present disclosure from.

Figure 1:
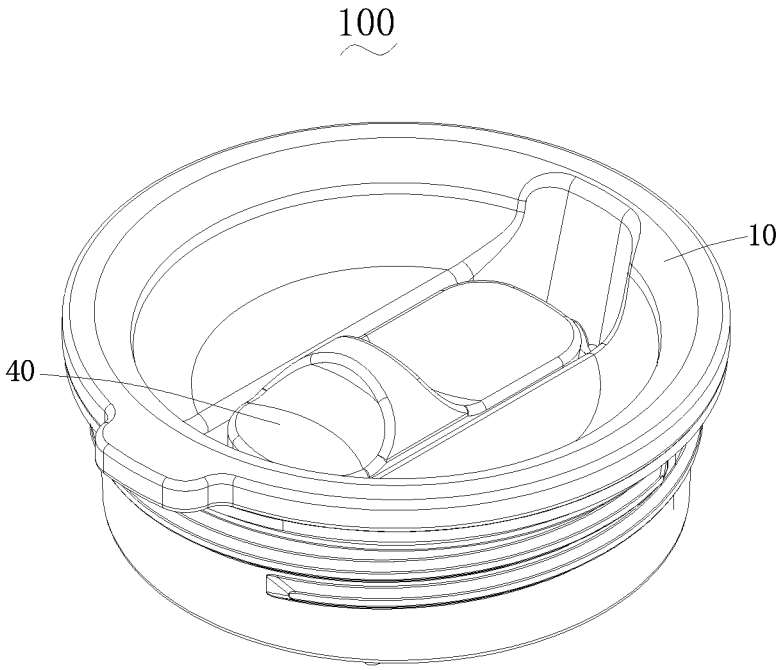
FIG. 1 is a structural schematic diagram of a container lid in an embodiment of the present disclosure.

In the figures, 10 represents a lid body; 11 represents a water outlet; 12 represents a sliding groove; 20 represents a sealing member; 21 represents a guiding portion; 211 represents a guiding surface; 212 represents a matching surface; 22 represents a abutting portion; 30 represents a resetting member; 31 represents a first magnetic portion; 32 represents a second magnetic portion; 40 represents a slidable member; 41 represents a driving portion; 411 represents a abutting surface; 412 represents a stopping surface; 50 represents a first gastight member; 60 represents a second gastight member; 100 represents a container lid; 200 represents a container; 210 represents a container body.

DETAILED DESCRIPTION

The technical solutions in the embodiments of the present disclosure will be clearly and completely described below in conjunction with the drawings in the embodiments of the present utility model. Obviously, the described embodiments are only a part of the embodiments of the present disclosure, rather than all the implementations. Based on the implementation of the present disclosure, all other implementations obtained by a person of ordinary skill in the art without creative work shall fall within the scope of protection of the present disclosure.

It should be noted that when an element is referred to as being "mounted" on another element, it may be directly mounted on the other element or a further element may be presented between them. When an element is considered to be "disposed" on another element, it may be directly disposed on the other element or disposed on the other element through a further element. When an element is considered to be "fixed" to another element, it may be directly fixed to the other element or fixed to the other element through a further element.

Unless otherwise defined, all technical and scientific terms used herein have the same meanings as commonly understood by those skilled in the art of the present disclosure. The terms used in the description of the present disclosure herein are only for the purpose of describing specific embodiments, and are not intended to limit the present disclosure. The term "or/and" as used herein includes any and all combinations of one or more related listed items.

With improvement of people's quality of life, the requirements for the convenience of daily necessities are getting higher and higher, and containers that can be opened and closed with one hand gains popularity. Many container control the flow of liquid from the container lid by an opening and closing mechanism provided on the container lid. However, in order to open and close the container lid with one hand, water outlet of those containers is sealed by the opening and closing mechanism from an inner side of the water outlet. However, dust is easy to accumulate on an outside of the water outlet of this type of container lid, and the sanitation is poor.

In view of the technical problem above, it is necessary to provide a container lid 100, which can shield a water outlet 11 to prevent dust from falling into the water outlet 11 and can be opened and closed with one hand, and effectively solve problems of dust accumulating on the outer side of the container lid 100, and the like. At the same time, the present disclosure provides a container 200 with the container lid 100.

Referring to FIG. 1 to FIG. 12, the present disclosure provides a container lid 100, which can be detachably disposed on a container body 210. In the present embodiment, the container lid 100 can be detachably fixed to the lid body 10 with the screw threads disposed around a side wall of the lid body 10. It should be understood that the container lid 100 can further be detachably connected to the container body 210 by methods of clamping and the like.

Figure 2:
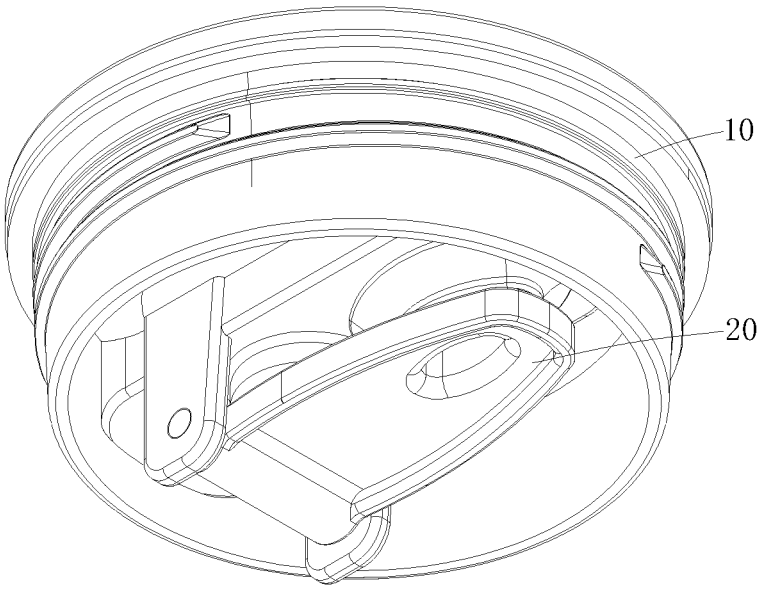
FIG. 2 is a structural schematic diagram of the container lid in an embodiment of the present disclosure from another viewing angle.
Figure 3:
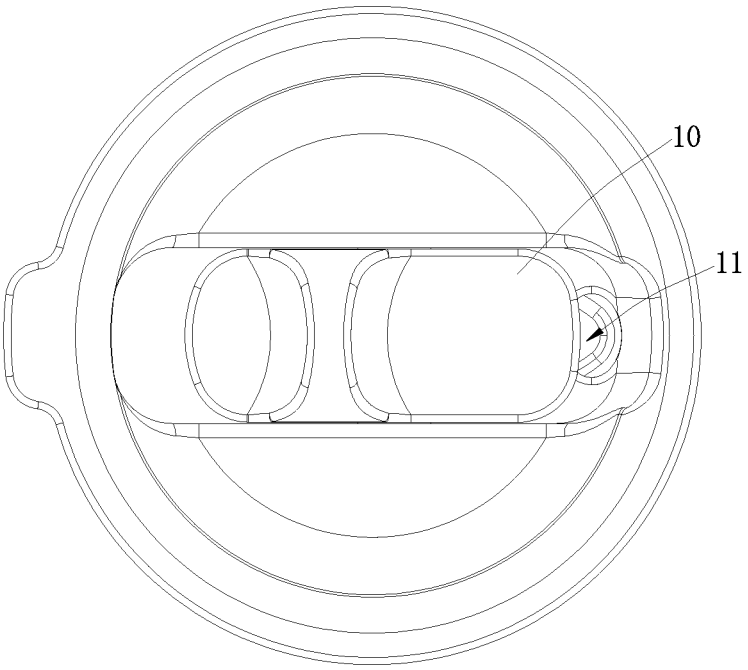
Figure 5:
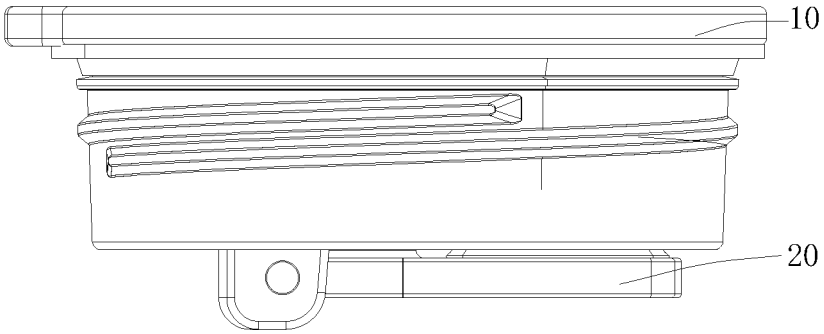
FIG. 5 is a side view structural schematic diagram of a container lid when the water outlet is in a sealed state in an embodiment of the present disclosure.
Figure 6:
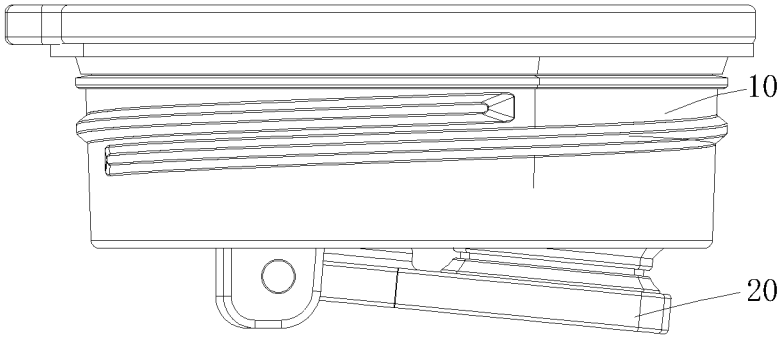
FIG. 6 is a side view structural schematic diagram of a container lid when the water outlet is in an opened state in an embodiment of the present disclosure.
Figure 7:
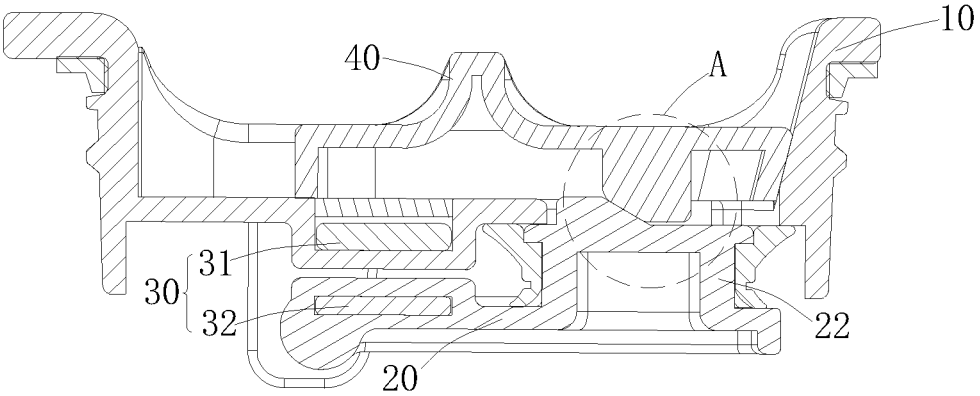
FIG. 7 is a cross section of a container lid when the water outlet is in a sealed state in an embodiment of the present disclosure.
Figure 8:
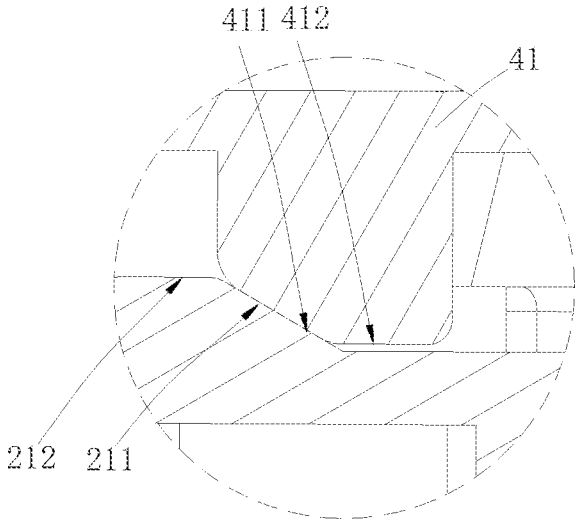
FIG. 8 is an enlarged structural schematic diagram at A portion in FIG. 7.
Figure 9:
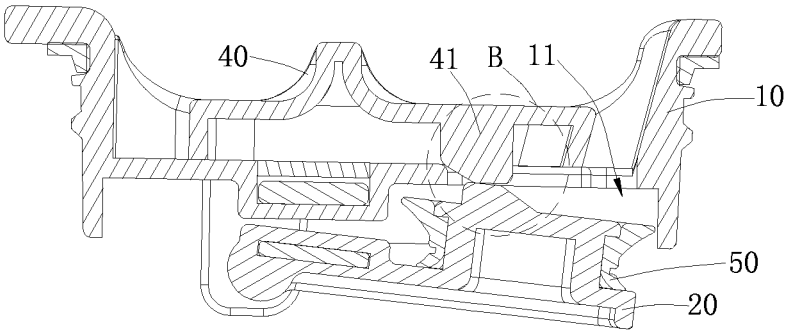
FIG. 9 is a cross section of a container lid when the water outlet is in an opened state in an embodiment of the present disclosure.

In some embodiments, the container lid 100 can include a lid body 10, a sealing member 20, a resetting member 30 and a slidable member 40. The lid body 10 can be provided with a water outlet 11. The sealing member 20 can be rotatably connected to the lid body 10, and configured to seal the water outlet 11. The resetting member 30 can be disposed on at least one of the lid body 10 and the sealing member 20, wherein the resetting member 30 can drive the sealing member 20 to seal the water outlet 11. The slidable member 40 can be slidably disposed on the lid body 10. FIG. 3, FIG. 6 and FIG. 9 show the container lid in the opened state. FIG. 2, FIG. 5 and FIG. 7 show the container lid when the water outlet is in the sealed state.

The slidable member 40 can be disposed at a first position and a second position relative to the lid body 10. When the slidable member 40 can be disposed at the first position, the water outlet 11 can be in a sealed state and be sealed by the sealing member 20 from an inner side of the lid body 10, and the water outlet 11 can be shielded by the slidable member 40 from an outer side of the lid body 10. When the slidable member 40 slides from the first position to the second position, the slidable member 40 can drive the sealing member 20 to rotate, the water outlet 11 can be in an opened state and the water outlet 11 is not shielded by the slidable member 40.

Referring to FIG. 2, the sealing member 20 can be rotatably connected to the lid body 10 via a rotation axis. In the present disclosure, a specific method for connecting the sealing member 20 to the lid body 10 is not limited. The sealing member 20 can be rotatably connected to the lid body 10 via a pivot, a hinge, or the like, as long as the sealing member 20 can be rotatably connected to the lid body 10. It should be noted that in the present disclosure, an inner side of the lid body 10 is a side of the lid body close to the container body 210, and an outer side of the lid body 10 is a side of the lid body away from the container body 210.

It should be noted that the slidable member 40 can be slidably disposed on the lid body 10. The lid body 10 can be closed or opened by reciprocate sliding of the slidable member 40. When the slidable member 40 is disposed in the first position, the slidable member 40 can effectively shield the water outlet 11 from the outer side of the lid body, and prevent dust from accumulating around the outer side of the water outlet 11 and falling into the water outlet, thereby ensuring drinking water hygiene. In addition, the resetting member 30 can drive the sealing member 20 to abut against the water outlet 11, thereby sealing the water outlet 11 with the sealing member 20. Therefore, the water outlet 11 can be in the sealed state, avoiding water flowing out from the water outlet 11.

When the user needs to drink water, the slidable member 40 can move along a preset path while pushing with one hand, thereby sliding the slidable member 40 from the first position to the second position. When the slidable member 40 is at the second position, the water outlet 11 is not shielded by the slidable member 40 at the outer side of the lid body 10 anymore, and the water outlet 11 is unsealed at the inner side of the lid body 10. Thus, the water outlet 11 can be opened, and water can be flow out. By cooperation between the slidable member 40 and the resetting member 30, the water outlet 11 can be shielded and sealed. This not only can ensure the user's drinking water hygiene while using the container 200 with the container lid 100, but also can facilitate the user opening and closing the container 200 with one hand, providing facility for the user.

Figure 4:
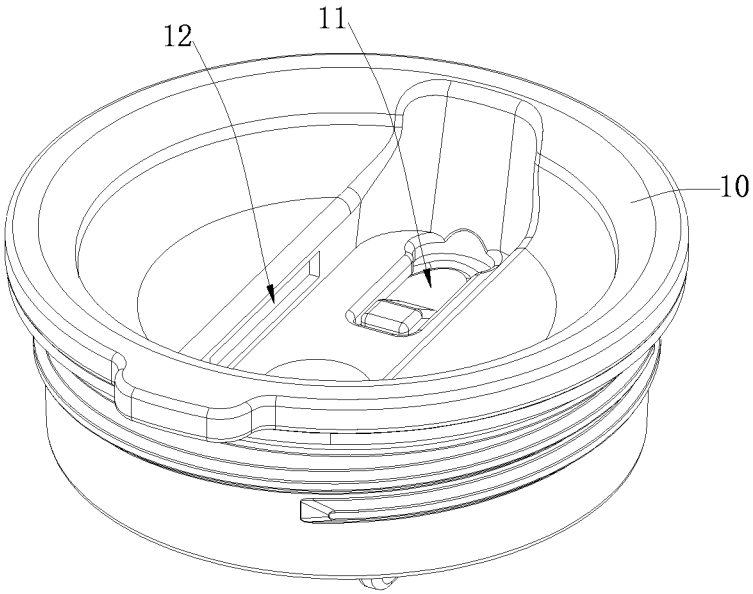
FIG. 4 is a structural schematic diagram of the container lid omitting a slidable member in an embodiment of the present disclosure.

Referring to FIG. 4, in the present embodiment, by designing a sliding groove 12 on the lid body 10 and correspondingly defining a protrusion (not shown in the figures) matching with the sliding groove 12 on the slidable member 40, the slidable member 40 can slide. It should be understood that the sliding groove 12 can be disposed on a side of the slidable member 40, and a protrusion matching with the sliding groove 12 can be disposed on the lid body 10. In some embodiments, the slidable member 40 can be provided with ball bearings, and the lid body 10 can be correspondingly provided with a pathway matching with the ball bearings, thereby realizing sliding of the slidable member 40. In the present disclosure, a specific sliding mode of the slidable member 40 is not limited, as long as the slidable member 40 can reciprocate and slide between the first position and the second position.

In some embodiments, referring to FIG. 5 to FIG. 8, the resetting member 30 can include a first magnetic portion 31 and a second magnetic portion 32. The first magnetic portion 31 can be disposed on the lid body 10, and the second magnetic portion 32 can be disposed on the sealing member 20. The sealing member 20 can seal the water outlet 11 by a magnetic force between the first magnetic portion 31 and the second magnetic portion 32. It is easy to understand that the first magnetic portion 31 and the second magnetic portion 32 can attract each other. In some embodiments, one of them can be a magnet, and the other is a metal that can be attracted by the magnet, such as iron, cobalt, nickel, and the like. In some embodiments, both of them can be magnets. In the present embodiment, both the first magnetic portion 31 and the second magnetic portion 32 can be magnets.

In order to facilitate the user using the container lid 100 with one hand, a metal elastic member (such as a spring) or a magnet can be used as the resetting member 30, so that the container lid 100 can be opened or closed with one hand. In some embodiments, by designing the first magnetic portion 31 and the second magnetic portion 32, and driving the sealing member 20 to seal the water outlet 11 at the inner side of the lid body 10 by attraction between the first magnetic portion 31 and the second magnetic portion 32, water leaking of the container lid 10 caused by sealing failure of the resetting member 30 after long time use can be avoided.

In the present embodiment, both the first magnetic portion 31 and the second magnetic portion 32 can be magnets attracting each other. The first magnetic portion 31 can be detachable disposed on the lid body 10, and the magnetic portion 32 can be formed on the sealing member 20 by secondary forming. It should be noted that the container lid 100 is generally pretty small. Therefore, it is relative hard to mount the metal elastic member on the container lid 100. However, since the magnet has a relatively small volume, it can be easily mounted on the lid body 10 and the sealing member 20, and can have a higher mounting efficiency and lower production cost. By detachably disposing the first magnetic portion 31 on the lid body 10, the magnet can be magnetized when it is demagnetized, thereby ensuring the sealing member 20 to seal the water outlet 11 at the inner side of the lid body 10 all the time.

It should be noted that since the magnet is easy to be mounted on the lid body 10 and the sealing member 20, and can be mounted on the lid body 10 and the sealing member by secondary forming, it can effectively prevent the resetting member 30 from contacting a content (such as coke, coffee and the like) in the container. Therefore, not only the user's drinking water hygiene can be ensured, but also the user will not need to clean the resetting member 30. It is convenient for the user. In addition, since the lid body 10 can be generally made of materials such as plastic and the like, the resetting member 30 can be prone to fall off from the lid body 10 when the lid body is damaged as striking to a hard object or the ground. The resetting member 30 separating from the lid body 10 can easily be ejected to other places and cause personal injury to the user. By designing a first magnetic portion 31 and the second magnetic portion 32 of the resetting member 30 as magnets, the resetting member 30 will still be attracted together even if they are separated from the resetting member 30, effectively avoiding accidents such has personal injury and the like.

In some embodiments, the first magnetic portion 31 can be disposed at a side of the lid body 10 close to the sealing member 20, and the second magnetic portion 32 can be disposed at a first side of the sealing member 20 close to the lid body 10. The first magnetic portion 31 can be disposed corresponding to the second magnetic portion 32, and the second magnetic portion 32 can be disposed close to the rotation axis of the sealing member 20 along a longitudinal direction of the sealing member 20. It should be understood that by disposing the first magnetic portion 31 adjacent to the second magnetic portion 32 and correspondingly disposing the first magnetic portion 31 and the second magnetic portion 32 near a pivot of the sealing member 20, a distance between the two can be effectively reduced. By reducing the distance between the first magnetic portion 31 and the second magnetic portion 32, it can be ensured that attraction between the first magnetic portion 31 and the second magnetic portion 32 can be relatively large, so that the sealing member 20 can have a relatively good sealing effect.

Referring to FIG. 5 to FIG. 8, the slidable member 40 can include a driving portion 41. The sealing member 20 can be provided with a guiding portion 21 at the first side of the sealing member 20 close to the lid body 40. When the slidable member 40 slides from the first position to the second position, the driving portion 41 can abut against the guiding portion 21 to drive the sealing member 20 to rotate around the rotation axis of the sealing member 20. By designing the guiding portion 21, when the slidable member 40 slides from the first position to the second position, the slidable member 40 can stably drive the drive the sealing member 20 to rotate around the rotation axis, thereby improving the user's experience of using the container lid 100.

In some embodiments, referring to FIG. 7 to FIG. 10, the driving portion 41 can be a protrusion disposed on the slidable member 40 and protruding towards the sealing member 20. The guiding portion 21 can be provided with a guiding surface 211 at a side of the guiding portion 21 close to the slidable member 40. The guiding surface 21 can be formed by a part of the sealing member 20 inclinedly extending along a sliding direction of the slidable member 40. The driving portion 41 can abut against the guiding surface 211. Therefore, by designing the guiding surface 211, stability of rotation of the sealing member 20 around the pivot driven by the slidable member 40 can be further improved.

Furthermore, the sealing member 20 can be further provided with a matching surface 212, the matching surface 212 can be extended from the guiding surface 211. When the slidable member 40 is disposed at the second position, a first end surface of the driving portion 41 can abut against the matching surface 212 to ensure the sealing member 20 to rotate being in an opened state. It should be understood that the driving portion 41 is a protrusion disposed on the slidable member 40 and protruding towards the sealing member 20. Therefore, an end surface of the protrusion away from the slidable member 40 and towards the sealing member 20 can be the first end surface. In the present embodiment, the first end surface of the driving portion 41 is not limited, as long as the first end surface of the driving portion 41 can abut against the matching surface 212 and ensure the sealing member 20 to rotate being in an opened state.

Since the resetting member 30 can drive the sealing member 20 to abut against the water outlet 11 at the inner side of the lid body 10, the user needs to push the slidable member 40 all the time to ensure opening the water outlet 11 to drink water. By designing the matching surface 212, when the slidable member 40 is disposed at the second position, the first end surface of the driving portion 41 can abut against the matching surface 212, keeping the sealing member 20 in the unsealing state. That is, abutting between the matching surface 212 and the first end of the driving portion 41 can keep them in a locked state. Therefore, the user can drink water without pushing the slidable member 40 throughout the drinking process, thereby improving the user's convenience.

Figure 10:
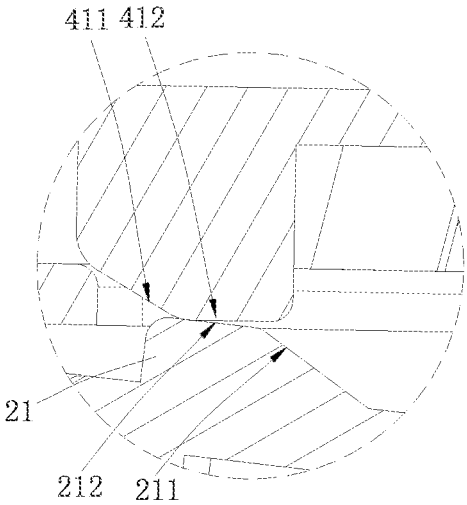
FIG. 10 is an enlarged structural schematic diagram at B portion in FIG. 9.

Furthermore, referring to FIG. 9 to FIG. 10, the driving portion 41 can be provided with an abutting surface 411 matching with the guiding surface 211, and a stopping surface 412. When the slidable member 40 slides from the first position to the second position, the abutting surface 411 can abut against the guiding surface 211. The stopping surface 412 can be disposed on the first end surface of the driving portion 41 close to the sealing member 20. When the slidable member 40 is disposed at the second position, the stopping surface 412 can abut against the matching surface 212. By designing the abutting surface 211 matching with the guiding surface 411, guiding effect of the guiding surface 211 can be further improved. By designing the stopping surface 412 matching with the matching surface 212, locking effect between the stopping surface 412 and the matching surface 212 can be further improved.

Referring to FIG. 5, the sealing member 20 can further include an abutting portion 22, wherein the abutting portion 22 can be disposed on an end of the sealing member 20 away from the rotation axis of the sealing member 20, and the guiding portion 21 can be disposed on the abutting portion 22. Designing the abutting portion 22 can facilitate the sealing member 20 to seal the water outlet 11 at the inner side of the lid body 10, and facilitate matching between the guiding portion 21 and the driving portion 41. In some embodiments, the container lid 100 can further include a first gastight member 50 disposed around the abutting portion 22. By designing the first gastight member 50, sealing effect of the sealing member 20 to the water outlet 11 at the inner side of the container lid 100 can be further improved.

In the present embodiment, the abutting portion 22 can be not entirely covered on the water outlet 11 at the inner side of the lid body 10, and the first gastight member 50 can seal a part of the water outlet 11 is not covered by the abutting portion 22 (a part of the water outlet 11 away from the rotation axis of the sealing member 20). By sealing the water outlet 11 together with the abutting portion 22 and the first gastight member 50, the sealing effect can be better. In some embodiments, the first gastight member 50 can be silica gel. The sealing member 20 can abut against the water outlet 11 by attraction between the first magnetic portion 31 and the second magnetic portion 32, so that the first gastight member 50 can deform to seal the part of the water outlet 11 that is not covered by the abutting portion 22.

Figure 11:
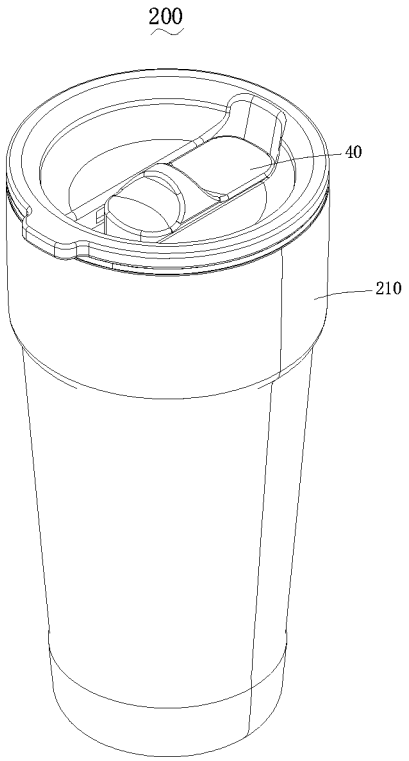
FIG. 11 is a structural diagram of a container in an embodiment of the present disclosure.
Figure 12:
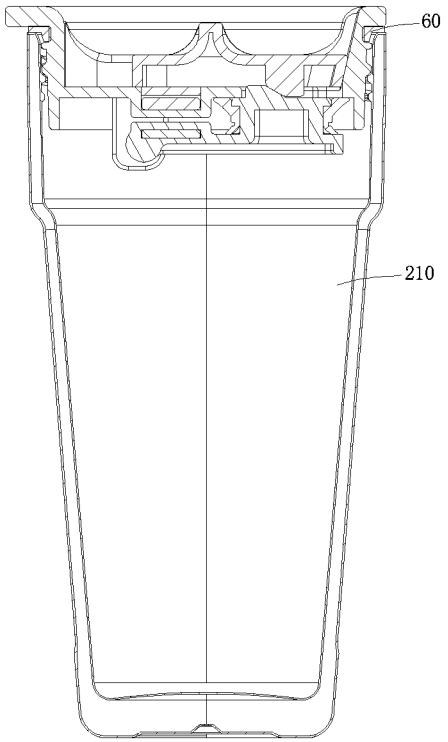
FIG. 12 is a cross section of a container in an embodiment of the present disclosure.

Referring to FIG. 11 and FIG. 12, the present disclosure can further provide a container 200, which can include a container body 210 and the container lid 100 described above. The container lid 100 can be detachably disposed on the container body 200. Designing the container 200 with the container lid 100 not only can prevent dust from accumulating around the water outlet or falling into the water outlet 11, but also can facilitate opening and closing the container 200 with one hand.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A container lid, comprising, a lid body provided with a water outlet;

a sealing member, wherein the sealing member is rotatably connected to the lid body, and configured to seal the water outlet;

a resetting member disposed on/in at least one of the lid body and the sealing member, wherein the resetting member is capable of driving the sealing member to seal the water outlet; and a slidable member, wherein the slidable member is slidably disposed at a first position and a second position on the lid body, when the slidable member is in the first position, the water outlet is in a sealed state and is sealed by the sealing member from an inner side of the lid body, and is shielded by the slidable member from an outer side of the lid body; when the slidable member slides from the first position to the second position, the slidable member drives the sealing member to rotate, the water outlet is in an opened state and the water outlet is not shielded by the slidable member;

the slidable member comprises a driving portion, the sealing member is provided with a guiding portion at the first side of the sealing member close to the lid body, when the slidable member slides from the first position to the second position, the driving portion abuts against the guiding portion to drive the sealing member to rotate around the rotation axis of the sealing member;

the driving portion is a protrusion disposed on the slidable member and protruding towards the sealing member, the guiding portion is provided with a guiding surface at a side of the guiding portion close to the slidable member, the guiding surface is formed by a part of the sealing member inclinedly extending along a sliding direction of the slidable member, and the driving portion abuts against the guiding surface; and, the sealing member is further provided with a matching surface, the matching surface is extended from the guiding surface, when the slidable member is in the second position, a first end surface of the driving portion abuts against the matching surface to ensure the sealing member to rotate and the water outlet being in the opened state.

2. The container lid of claim 1, wherein the resetting member comprises a first magnetic portion and a second magnetic portion, the first magnetic portion is disposed in the lid body, and the second magnetic portion is disposed in the sealing member, the sealing member is capable of sealing the water outlet by a magnetic force between the first magnetic portion and the second magnetic portion.

3. The container lid of claim 2, wherein the first magnetic portion is disposed at a side of the lid body close to the sealing member, the second magnetic portion is disposed at a first side of the sealing member close to the lid body, the first magnetic portion is disposed corresponding to the second magnetic portion, and the second magnetic portion is disposed close to a rotation axis of the sealing member and along a longitudinal direction of the sealing member.

4. The container lid of claim 1, wherein the driving portion is provided with an abutting surface and a stopping surface, wherein the abutting surface matches with the guiding surface, when the slidable member slides from the first position to the second position, the abutting surface abuts against the guiding surface; and the stopping surface is disposed on the first end surface of the driving portion close to the sealing member, when the slidable member is in the second position, the stopping surface abuts against the matching surface.

5. The container lid of claim 1, wherein the sealing member further comprises an abutting portion, wherein the abutting portion is disposed on an end of the sealing member away from the rotation axis of the sealing member, and the guiding portion is disposed on the abutting portion.

6. The container lid of claim 5, further comprises a first gastight member disposed around the abutting portion.

7. A container, comprising a container body, and a container lid of claim 1, wherein the container lid is detachably disposed on the container body.

* * * * *